US005572832A

United States Patent [19]

Haavisto et al.

[11] Patent Number: 5,572,832

[45] Date of Patent: Nov. 12, 1996

[54] SUPPORT STRUCTURE

[75] Inventors: Seppo Haavisto, Hämeenkyrö ; Risto Sutti, Vuorentausta, both of Finland

[73] Assignee: Tampella Papertech Oy, Tampere, Finland

[21] Appl. No.: 315,865

[22] Filed: Sep. 30, 1994

[51] Int. Cl.[6] ..... E04C 3/00

[52] U.S. Cl. ..... 52/1; 52/730.1; 52/731.1; 52/731.2; 52/737.6

[58] Field of Search ..... 52/1, 731.2, 731.1, 52/732.1, 730.1, 737.6, 729.2

[56] References Cited

U.S. PATENT DOCUMENTS 2,125,692 8/1938 Ragsdale ..... 52/731.2

*Primary Examiner*—Robert Canfield

*Attorney, Agent, or Firm*—Ladas & Parry

[57] ABSTRACT

A support structure having a beam portion (2) undergoing bending when the load is imposed on the support structure and a separate elastic member (1*a*) which deforms elastically in a manner inversely proportional to beam bending from the middle of the support structure towards its ends so that the sum of the deformation produced by beam bending and the deformation of the elastic member is constant, whereby a longitudinal support line in the support structure remains as a straight line even though the support structure itself yields in the direction of the force.

21 Claims, 3 Drawing Sheets

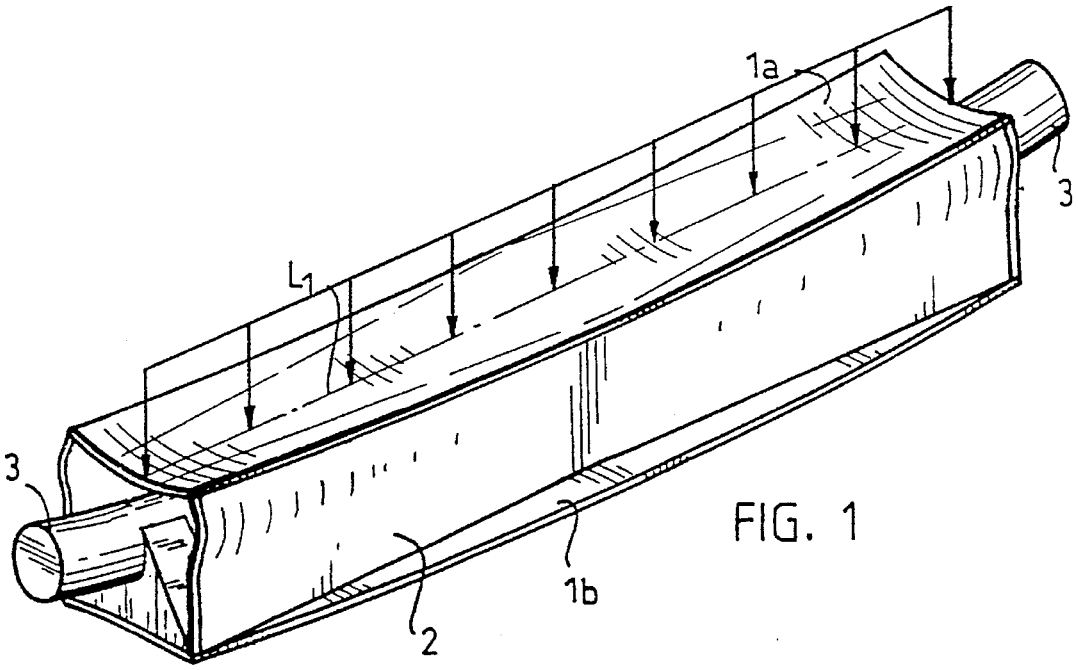
FIG. 1
FIG. 2a
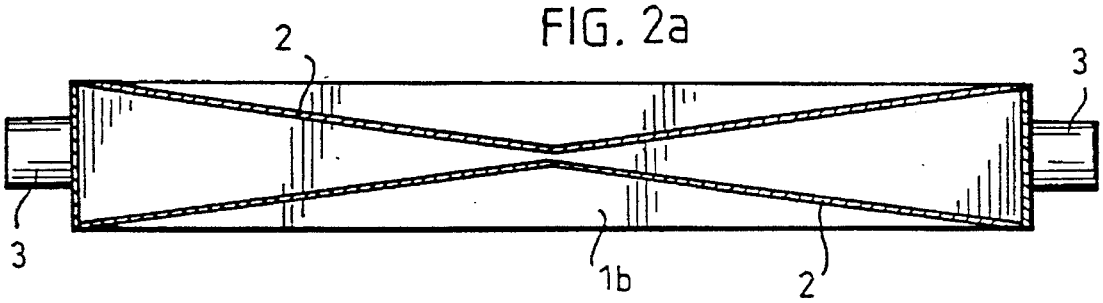
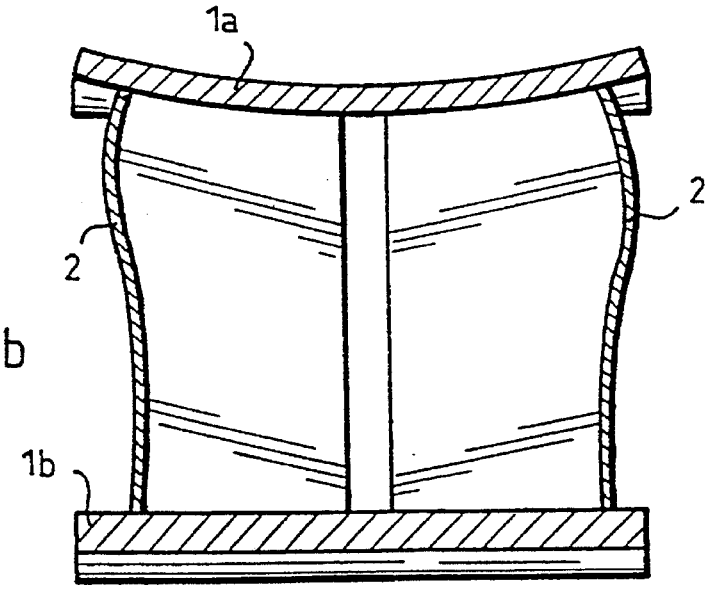
FIG. 2b

FIG. 6a
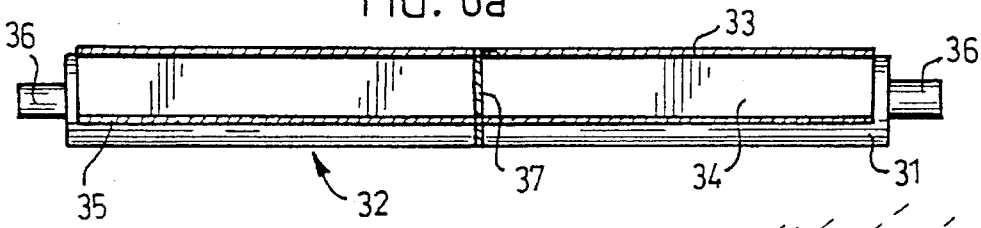
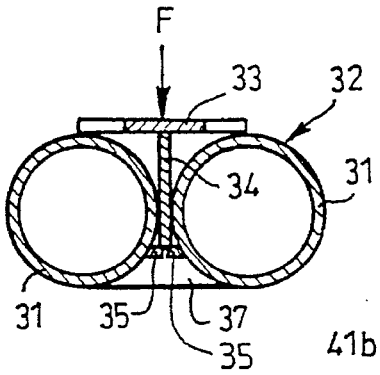
FIG. 6b
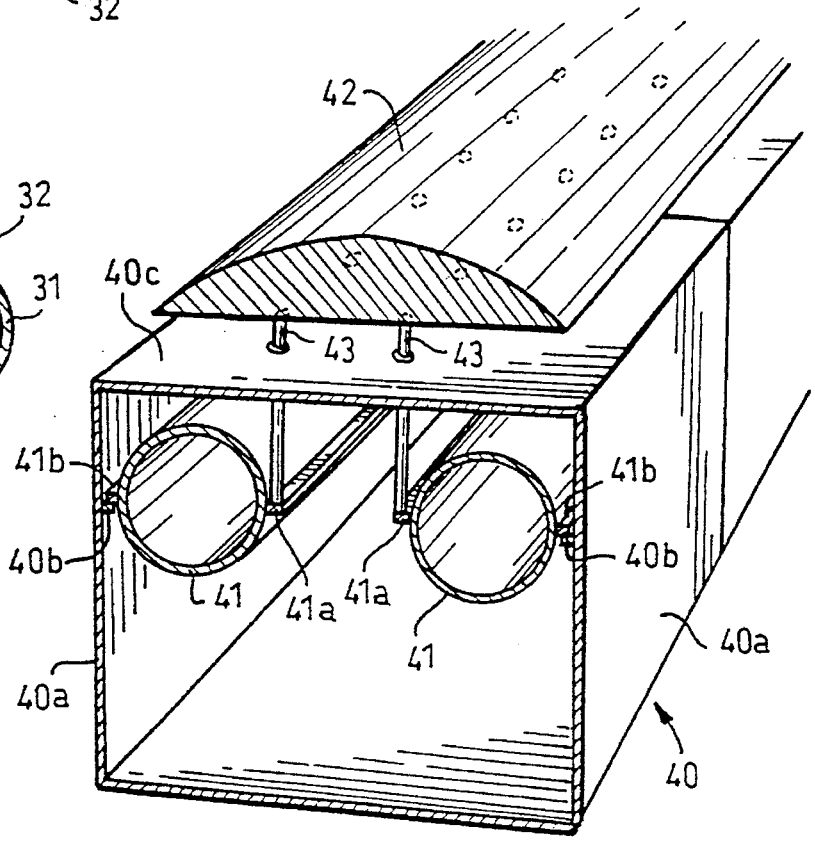
FIG. 7
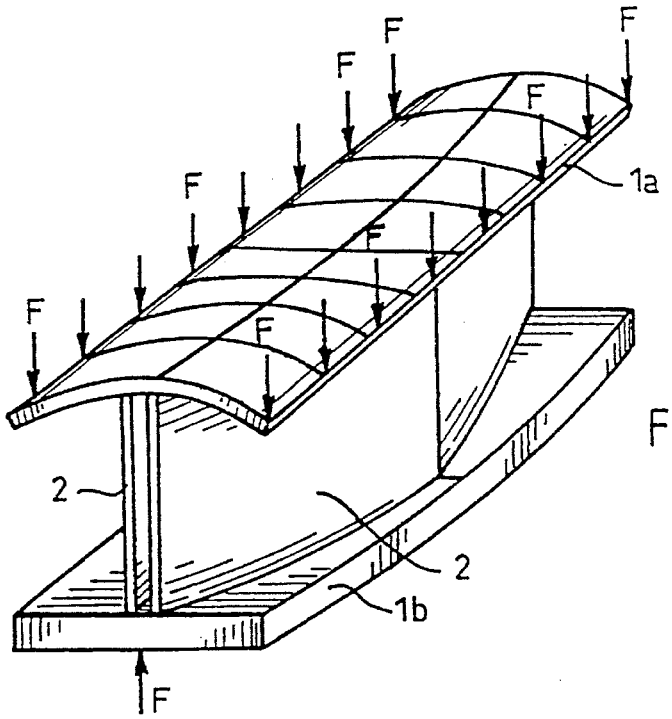
FIG. 8

SUPPORT STRUCTURE

FIELD OF THE INVENTION

This invention relates to an elongated support structure, such as a support beam, supported at least at one point and having a load distribution that is at least partly continuous, or can be interpreted as such due to a number of adjacent point loads, the support structure comprising, within a load-carrying area or on a load-carrying line, at least two elements moving substantially elastically under the influence of load, one of such elements being a deflection of a support frame.

A force acting on structures deforms them. This is disadvantageous especially in elongated support structures under load, as excessive deflections can occur during operation of the supported device. This is difficult to compensate particularly in cases where the distribution of load is continuous at least over a portion of the area or line of action. The distribution of load can be considered to be continuous if it consists of a number of adjacent point loads, between which there occur no substantial deflections in the structure.

BACKGROUND

SUMMARY OF THE INVENTION

The object of the present invention is to provide a simple support structure without the use of active means. The support structure operates solely by utilizing elasticity effects, and its load-supporting section maintains its shape, e.g. its straightness, irrespective of the load, although it moves evenly under the influence of the force until the material yields or breaks. In view of the operation, the mere even displacement under the influence of load is a much better alternative than deflection. One reason for this is that displacement is much easier to compensate than deflection.

This type of support is used e.g. as a frame in various press and calender rolls, and to support the lip of a head box in a paper machine and e.g. blades of coating means in coating devices.

Solutions presently in use are based on hydraulic support structures, the drawbacks of which include high price, required complicated adjustment technology, risk of contamination caused by hydraulic oil, and poor reliability and high weight of the complicated apparatus.

The invention is based on the idea that the total elasticity of the load-supporting area or line (of which there may be several in one and the same structure) with respect to the supporting points of the structure is inversely proportional to the distribution of load over the entire area or line. In other words, the distribution of load and the stiffness distribution of the structure with respect to the supporting points of the structure against the loading force are proportional to each other over the entire load-supporting area. The unbending area or line of the support is moved elastically by a certain force to the same extent both in the middle and at the ends as well as therebetween. In practice, this is achieved by providing one or more additional elastic elements between the central top line of the beam and the supporting points Of the beam in such a way that the sum of the elasticity effects and the deflection is constant over the entire straight portion. Elasticity is assumed to be the inverse of stiffness, i.e.

stiffness, $K=F/\delta$; elasticity, $D=1/K=\delta/F$

This principle can be realized in several different ways. In a normal case, an elongated beam supported at the ends is strained by a force uniformly distributed from one end to the other. The longitudinal lines of the beam, straight before loading, are bent by the force into a curved shape. According to the invention, the frame is provided with another elastic element, the elasticity effect thereof adding to the deflection of the beam. This elasticity effect increases towards the ends of the frame so that the sum of the elasticity of the frame and the other elasticity effect is constant everywhere along the beam. This can be arranged simply e.g. by using a deformation, such as flattening, of the longitudinally varying cross-section of a support beam, or a twisting of the support structure or its portion under the influence of the load as an additional elasticity effect. It is also possible to use elastic means or supports to provide the additional elasticity effect.

The invention is characterized in that a stiffness distribution calculated on the basis of the sum of the elasticity effects of said elastic elements with respect to the supporting points within the unbending area or on the unbending line is directly proportional to the distribution of load so that the load-carrying points define a line or sequence which remains unchanged in shape when the magnitude of the load changes.

The advantages of the invention include simplicity, low price, light weight, and reliability.

BRIEF DESCRIPTION OF THE DRAWINGS

In the following the invention will be described more fully with reference to the attached drawings, where FIG. 1 is a schematic perspective view of a support structure according to the invention under load;

FIG. 2*a* is a top view of the support structure shown in FIG. 1 in a horizontal section;

FIG. 2*b* is a transverse cross-sectional view of the support structure shown in FIG. 1 in a loaded state;

FIGS. 6*a* and 6*b* are a longitudinal and a transverse cross-sectional view, respectively, of the support structure shown in FIG. 5;

FIG. 7 is a perspective view of a fourth support structure according to the invention; and FIG. 8 is a perspective view of a fifth support structure according to the invention.

DETAILED DESCRIPTION

Figure 3:
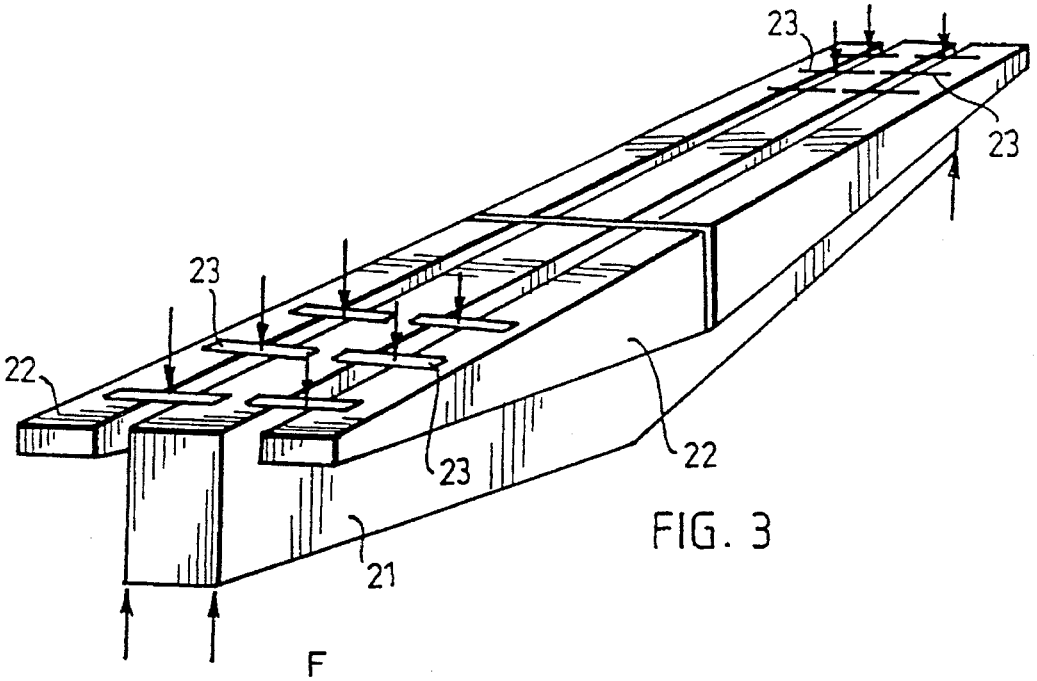
FIG. 3 is a schematic perspective view of another support structure according to the invention.

FIG. 1 shows a support structure according to the invention under load. The support structure comprises flange plates 1*a* and 1*b*, and vertical web plates 2 positioned therebetween. Furthermore, gripping heads 3, preferably tubular or round in cross-section, are attached to the ends of the web plates and to the lower flange plate. As appears from FIG. 1, the support structure has been deformed under load so that the web plates 2 forming the frame in a plane perpendicular to the longitudinal axis of the support structure in the middle of the structure have bent downward to a certain extent. Correspondingly, the upper flange plate 1*a* has been curved at the ends of the support structure in such a way that it is downwardly concave. In this embodiment, the flange plate la and the web plates 2 together form an elastic element the incurvature of which in the transverse direction of the support structure depends on the load. The operating principle of the structure appears particularly clearly from FIGS. 2*a* and 2*b*. FIG. 2*a* shows the lower flange plate 1*b* of the beam, and, above it, the web plates 2 that form a major portion of the load-carrying frame. The web plates 2 start from the corners of the flange plate 1*b* e.g. at the ends of the support structure and approach the central line of the support structure towards the center of the structure. Thus, the smaller the distance from the center of the support structure, the greater the proportion of load acting directly on the web plates 2. Correspondingly, the upper flange plate 1*a*, not shown in FIG. 2*a*, has the same shape as the flange plate 1*b* and it is similarly mounted on the upper surface of the support structure, as shown in FIG. 1. As the flange plate 1*a* is attached to the web plates 2, a load imposed on the mid portion of the support structure, i.e. in the middle of the flange plate 1*a*, acts directly substantially on the web plates 2 only. The shorter the distance from the ends of the support structure, the greater the distance between the web plates 2, end correspondingly, the flange plate 1*a* is able to bend under load below the edges of the web plates to a greater extent on the central line. This appears clearly from FIG. 2*b*, which shows how the upper flange plate 1*a* and thus also the web plates 2 have been curved. When the dimensions of the flange plate 1*a* and the web plate 2 are selected suitably and the shape of the web plates 2 is selected appropriately, the support structure bends under load similarly as a normal support structure, but the flange plate 1*a* at the ends of the support structure bends elastically according to the load. The displacement caused by the load is thereby equal to normal deflection in the mid span of the support structure and the elastic bending of the flange plate 1*a* increases correspondingly towards the ends as the deflection decreases. As a result, a line L1 extending on the upper surface of the support structure is displaced under the influence of the loading force with respect to the mounting point of the ends 3 of the support structure but it is still straight.

FIG. 3 shows another embodiment of the support structure according to the invention, where the frame of the support structure comprises a central beam 21 with certain dimensions, to the sides of which elastic beams 22 acting as elastic elements are mounted. The elastic beams 22 and the central beam 21 are interconnected in the middle of the support structure so that they are not able to move with respect to each other in the middle of the support structure. Support arms 23 are provided between the central beam and the elastic beams. They are formed in such a way that their both ends continuously bear on the central beam and the elastic beam, respectively. When a load is imposed on the support structure shown in FIG. 3, the central beam 21 bends as is usual under normal loading, whereby the mid span of the support structure sinks with respect to the supporting and mounting points, downwards in the figure. Correspondingly, the elastic beams 22 sink with respect to the central beam 21, in an amount which increases as the distance from the mounting point of the support structure decreases, i.e. the ends of the support structure. Depending on the type of load applied and the structure of the support arm, a suitable structure can be provided for a load acting on a single line or for two loads acting at a distance from each other in the same direction.

Figure 4A:
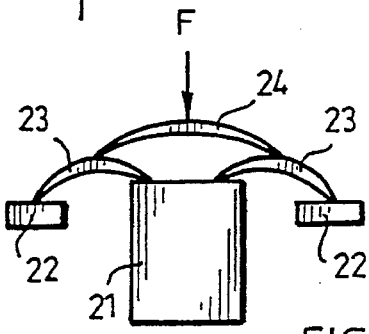
FIGS. 4*a* and 4*b* are end views of the support structure shown in FIG. 3 with two different ways of loading and supporting.
Figure 4B:
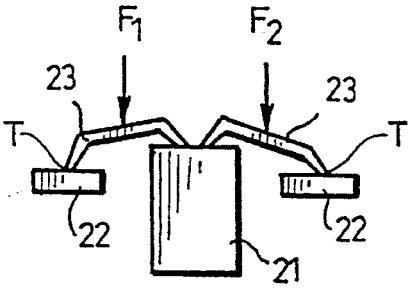

FIGS. 4*a* and 4*b* show embodiments for the different ways of loading. As appears from FIG. 4*a*, the first support arms 23 between the beams 21 and 22 bear on the beams 21 and 22 at the ends. Such support arms 23 are provided over the length of the support structure at suitable spacings, depending on the load and the structure and load resistance of the support arms 23. Another support arm 24 is mounted upon the support arms 23. When the beams 21 and 22 have suitable dimensions, a straight line passes through the ends of the successive support arms 24 mounted similarly over the length of the support structure, and thus a straight lane will be obtained in the area on which the force F acts, irrespective of the elasticity of the support structure. FIG. 4*b* shows a solution of the same kind, but this solution uses merely the support arms 23 positioned on both sides of the beam 21. In this case, the load is supported on the successive support arms provided over the length of the support structure so that the same supporting point of all of the support arms 23, i.e. the support point T is on a straight line in the area on which forces F1 and F2 act.

Figure 5:
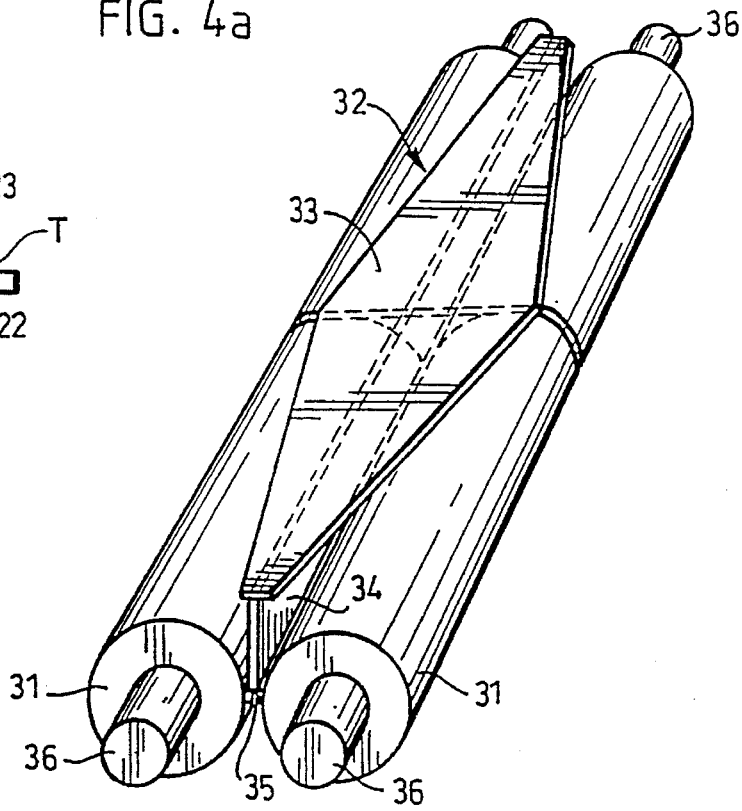
FIG. 5 is a schematic perspective view of a third support structure according to the invention.

FIG. 5 shows a third embodiment of the support structure according to the invention, where the support structure comprises tubular elastic beam sections and a support frame positioned between them. In FIG. 5, the tubular beam sections 31, which form a frame, are interconnected in the middle of the support structure so that they are not able to twist with respect to each other in the middle of the support structure. The support frame 32 is also attached to the tubular beam sections 31 in the middle of the support structure. The support frame 32 has a plate-like support surface 33 and a web plate 34 which transmits a loading force imposed on the support surface 33 onwards. The tubular beam sections 31 are apart from each other from the mid point up to the ends of the support structure, and support strips 35 are provided between them, the web plate 34 bearing on the support strips. Moreover, round or tubular gripping heads 36 are provided at the ends of the tubular beam sections. The tubular beam sections can turn about their longitudinal axes-when supported by the gripping heads.

FIGS. 6*a* and 6*b* show a longitudinal vertical and transverse section of the support structure shown in FIG. 5, respectively. It can be seen from the figures how the web plate 34 of the support frame 32 is in contact with the support strips 35 on both sides of its mid portion up to the ends of the support structure. When the support structure is loaded, it bends downward at the middle, so that the tubular beam sections twist elastically and their twisting allows the web plate 34 and the support surface 33 of the support frame 32 to sink at the ends of the support structure to the same extent as the bending of the mid portion of the support structure under the influence of the load. The tubular frame sections thus themselves act as an elastic element, as a result of which the support line or support plane on the upper surface of the support frame 32 is again remains straight. The support frame 32 can be connected to the tubular beam sections 31 e.g. by means of a suitably shaped support plate or support flange 37 in such a way that it will absolutely secure the tubular beam sections 31 unrotatably with respect to each other in the middle of the support structure. In place of the support strips 35, it is possible to use uniformly spaced support projections or support claws or any other suitable support member arrangement which allows the load to be distributed evenly over the length of the tubular beam sections 31 for allowing their elastic twisting. Similarly, it is possible to use, in place of the tubular frame sections 31, frame sections angular in different ways, such as beams or other suitably shaped frame sections, provided that they carry the load and bend elastically in accordance with the invention.

FIG. 7 is a perspective, partial sectional view of a fourth embodiment of the support structure according to the invention. In this embodiment, the frame of the support structure is formed by a box-like frame portion 40, within which tubular elastic members 41 are attached so that they are positioned centrally in the frame portion 40 and unrotatably secured to it. Support strips 40*b* are attached to the inside of vertical side walls 40*a* of the frame portion 40. Correspondingly, support strips 41*a* and 41*b* are provided on both sides of the tubular elastic members, being preferably attached as continuous strips over the length of the tubular elastic member 41. In the beam structure, the support strip 41*b* is positioned above the support strip 40*b* of the frame portion 40. Furthermore, a support member 42, such as a shoe or the like support, is mounted above the frame portion 40. From the lower end of the support member 42, support arms 43 extend through the upper surface 40*c* of the frame portion 40 above the support strip 41*a* of both of the elastic members 41 so that the support member 42 is able to bear on the support strip. When the support structure is loaded, the load bears on the shoe or the like 42, so that the frame portion 40 bends. As a result of loading, the elastic members 41 are also under load, and the force presses them through the support arms 43 and the support strips 41*b* and 41*b*, causing them to be twisted about their longitudinal axis from the middle of the support structure towards its ends. The twisting angle increase as the distance from the end of the support structure decreases. As a result, the deflection caused by the load is again compensated by the additional elastic movement, and so the shoe or other support member remains straight under the load. The same principle can also be realized by using a single box-like frame portion and a single elastic member within it, as in the structure shown in FIG. 7. The shoe 42 can also be omitted, and the loading means or device can be positioned directly upon the support arms 43 or the like.

FIG. 8 shows a structure that, in principle, corresponds to that shown in FIG. 1, except that the web plates 2 are arranged therein so that they are positioned on the central line of the support structure at the end of the structure and approach the edges of the lower flange plate 1*b* towards its center. Correspondingly, the upper flange plate la bends under the influence of a load imposed on the edges to a greater extent at the ends of the support structure than in the middle thereof, whereby the shape of the edges of the upper flange portion remains straight under the influence of load.

If one wishes to construct a support structure where the supporting points are positioned in the middle of the support structure or somewhere else between the ends of the support structure, as at Bessel's points, it is possible to connect two or more parts according to one of the support structures according to the invention one after another into an integral support structure, or to interconnect a number of components corresponding to the parts of the support structure over a predetermined distance so that a deflection and elastic movement suitable for the supporting points will be obtained, the end result being a straight linear or planar support.

The invention has been described above and in the drawings only by way of example, and it is not in any way limited to this description. The above examples deal only with elastic support structures, such as beams, suitable for the solution with uniform load, but, on this principle, the support structure can also be designed for asymmetric and oblique loads so that the support line or support surface will remain straight under the design load. Even though the figures show the loading and the support structures typically in such a way that the load acts on the upper surface of the support structure and presses the support structure from above downward, it is, of course, obvious that the support structures can be mounted in different positions according to the load to receive loads acting either from above downward or from below upward or to receive and support horizontal or oblique loads. The support structure need not either be supported at the ends, but it can also be applied to beams or cantilever beams supported at the so-called Bessel's points or in the middle.

We claim:

1. An elongated support structure having a longitudinal axis subjected to a load having a distribution which is at least partly continuous lengthwise along the elongated support structure, said support structure comprising first and second elements connected together and elastically deformable under the applied load, said elements being constructed and supported to undergo bending deformation produced by said load, said elements being constructed and connected to constitute means for producing deformation of said elements in inverse relation to one another by the load such that the net deformation of said first element along a longitudinal line therein disposed in a plane containing said load is a linear displacement in which said longitudinal line remains straight.

2. An elongated support structure as claimed in claim 1, wherein said load distribution is uniform and said first and second elements are constructed to undergo deformation to produce uniform displacement of said longitudinal line.

3. An elongated support structure as claimed in claim 1, wherein said support structure comprises a box beam including two vertical web plates and upper and lower flange plates connected to said web plates at respective edges thereof, one of said flange plates defining said first element, said web plates and the other of said flange plates defining said second element, said box beam having opposite ends, said web plates being spaced apart transversely in said box beam by a distance which varies from the ends of the box beam towards a middle of the box beam.

4. An elongated support structure as claimed in claim 3, wherein said longitudinal line of said first element is disposed substantially centrally along the length of the box beam, the spacing of said web plates decreasing from the ends of the box beam towards the middle of the box beam.

5. An elongated support structure as claimed in claim 3, wherein said load is applied to said one of said flange plates at opposite longitudinal edge regions thereof, the spacing of said web plates increasing from the ends of the box beam towards the middle of the box beam.

6. An elongated support structure as claimed in claim 1, wherein said second element comprises two support members connected together to undergo twisting relative to the longitudinal axis of the support structure.

7. An elongated support structure as claimed in claim 6, wherein said two support members respectively comprise beams extending longitudinally along the length of the support structure.

8. An elongated support structure as claimed in claim 7, wherein said beams are parallel.

9. An elongated support structure as claimed in claim 7, wherein said beams are tubular.

10. An elongated support structure as claimed in claim 7, wherein said support structure comprises a frame, said beams each being connected along a longitudinal generatrix thereof to said frame and being subjected to applied load at a diametrically opposite longitudinal generatrix thereof.

11. An elongated support structure as claimed in claim 10, wherein said beams are arranged to receive applied load substantially centrally along the longitudinal axis of the support structure.

12. An elongated support structure as claimed in claim 11, wherein said beams are connected together centrally along the longitudinal axis of the support structure.

13. An elongated support structure as claimed in claim 7, wherein said first element comprises a load receiving member and a load transmitting means connected to said beams for transmitting load thereto from said load transmitting member.

14. An elongated support structure as claimed in claim 7, wherein said two beams are interconnected substantially centrally along the longitudinal axis of the support structure, said first element including a load receiving member and a load transmitting means connected to said beams for transmitting load thereto from said load receiving member to produce twisting of said beams.

15. An elongated support structure as claimed in claim 14, comprising a support plate in the middle of the support structure securing said two beams together against relative twisting.

16. An elongated support structure as claimed in claim 15, wherein said load receiving member comprises a support frame having a transverse width which increases from the ends of the support structure towards the middle thereof.

17. An elongated support structure as claimed in claim 16, wherein said beams have respective ends and comprise gripping heads at said respective ends for external support of the supporting structure, said beams being twistable relative to said gripping heads.

18. An elongated support structure as claimed in claim 1, wherein said second element comprises a main beam having opposite ends at which the beam is externally supported, said first element comprising an auxiliary beam extending adjacent to said main beam and secured thereto at the middle of the main beam, and transverse load-carrying supports connecting said main beam and said auxiliary beam to transfer load applied to said transverse load-carrying supports to said main and auxiliary beams.

19. An elongated support structure as claimed in claim 18, wherein said transverse load-carrying supports are longitudinally spaced along the length of the main and auxiliary beams, said main and auxiliary beams extending substantially parallel to one another.

20. An elongated support structure as claimed in claim 1, wherein said first and second elements comprise first and second beams extending parallel to one another, means securing said beams together, means supporting one of said beams externally at a distance from the means securing the beams together, and a plurality of load-carrying transverse supports connecting said beams together to transfer load applied to said load-carrying supports to said main and auxiliary beams.

21. A support structure comprising a beam having opposite ends with supports at said ends for external support of the beam and means for applying a distributed load on said beam at least partly continuous along said beam to produce bending deformation of said beam, said means including an elastic support connected to said beam to receive said load and transmit said load to said beam and undergo bending deformation with said beam, said elastic support being constructed to provide means for producing additional deformation of said elastic support under said load which is substantially the inverse of said bending deformation of said beam so that a longitudinal line in said elastic support which is disposed in a plane containing said load undergoes a net displacement in which said line remains straight.

* * * * *